United States Patent [19]

Folger et al.

[11] 4,387,679

[45] Jun. 14, 1983

[54] OVERSPEED PROTECTIVE SYSTEM FOR INTERNAL COMBUSTION ENGINES

[75] Inventors: Philip M. Folger; Bobby L. Johnson, both of Erie, Pa.

[73] Assignee: General Electric Company, Erie, Pa.

[21] Appl. No.: 184,494

[22] Filed: Sep. 5, 1980

[51] Int. Cl.[3] ..... F02D 1/04; F02B 77/08

[52] U.S. Cl. ..... 123/198 D; 123/198 DB; 123/372; 123/386

[58] Field of Search ..... 123/198 D, 198 DB, 365, 123/377, 386, 388, 397, 401

[56] References Cited

U.S. PATENT DOCUMENTS

| | | | |
|---|---|---|---|
| 1,220,133 | 3/1917 | Jenkins | 123/ |
| 2,645,474 | 7/1953 | Barnes | 123/198 DB |
| 3,025,843 | 3/1962 | Wagner | 123/198 DB |
| 4,148,289 | 4/1979 | Hewitt | 123/198 D |
| 4,351,293 | 9/1982 | Hewitt | 123/198 D |

FOREIGN PATENT DOCUMENTS

| | | | |
|---|---|---|---|
| 2314450 | 10/1973 | Fed. Rep. of Germany | 123/365 |

OTHER PUBLICATIONS

General Electric Instruction Book GEK-18050C Describing Prior Art Overspeed-Derater Links, (May 1978).

*Primary Examiner*—Charles J. Myhre
*Assistant Examiner*—Carl Stuart Miller
*Attorney, Agent, or Firm*—Albert S. Richardson, Jr.

[57] ABSTRACT

An internal combustion engine overspeed protection system utilizes a spring-actuated expandable overspeed link in the fuel control linkage to shut off fuel independently of governor or throttle action. The link is normally latched in a contracted condition and positioned in the fuel linkage between a manual fuel lever and the fuel cranks for the respective cylinders of the engine. An automatically resetable hydraulic actuating device unlatches the link in high speed response to an engine overspeed condition. A spring coupling in the fuel linkage permits relatching of the overspeed link by manipulation of the fuel lever.

8 Claims, 7 Drawing Figures

OVERSPEED PROTECTIVE SYSTEM FOR INTERNAL COMBUSTION ENGINES

BRIEF SUMMARY OF THE INVENTION

This invention relates to overspeed protective systems for internal combustion engines, including particularly an overspeed responsive shutdown link improved in design and positioned for improved cooperation with other elements in the engine fuel supply linkage.

The invention is especially applicable to diesel engines used to drive electric power generators or alternators in electrically propelled traction vehicles such as diesel-electric locomotives. In the preferred embodiment of our overspeed protective system the fuel control linkage of the engine includes a spring actuated expandable link that is normally latched in a contracted condition by an improved hydraulic actuator which unlatches the link in high-speed response to engine overspeed and then automatically resets to a latch effecting state. This improved actuator is the invention of Philip M. Folger, one of the joint inventors of the invention claimed in this application, and it is claimed in U.S. patent application Ser. No. 184,495 (now U.S. Pat. No. 4,350,053) filed concurrently herewith and assigned to the same assignee as is the present application.

Large diesel engines driving electric generators or alternators in diesel-electric locomotives and the like are commonly provided with a main governor controlled by a manual throttle to select any one of several constant speeds within a normal range of speeds, and in addition, with an overspeed governor coupled to actuate the fuel supply linkage to a shutdown position in response to the occurrence of a predetermined excessive engine speed and independently of the main governor and throttle. In current practice the main governor includes a movable output member, usually a hydraulic piston, the position of which determines through a mechanical linkage the quantity of fuel supplied to the engines cylinders. To provide overspeed protection, it is usual to include in the fuel linkage a longitudinally extensible overspeed link normally retained in contracted condition by fluid pressure. When extended by release of fluid pressure the overspeed link moves that portion of the fuel linkage beyond the link, including the fuel control racks, to fuel shut-off position independently of the main governor position. A separate overspeed governor is provided to abruptly reduce fluid pressure to the overspeed link in response to a predetermined engine overspeed above the normal range of speeds.

Once a diesel engine is shut down, it is often quite difficult to restart. During cranking, engine speed is low and hydraulic fluid pressure pumps driven by the engine are slow to build up fluid pressure, particularly if the locomotive battery has a relatively low charge. In the overspeed link described above, near normal fluid pressure must be restored to reset (i.e. contract) the link so that the fuel racks may be restored to a fuel supplying position. In practice the fluid pressure relief valve in the overspeed governor sometimes sticks and wholly prevents resetting of the overspeed link. To overcome such problems, it is not uncommon for operators to attempt engine starting by manipulating the fuel control linkage manually. The prior art overspeed link is ineffective at this time, so that engine overspeed protection is not then available. Such manual starting is thus dangerous and undesirable.

Accordingly, it is a general objective of our invention to so design and locate an overspeed link that manual actuation of the fuel linkage may take place without negation of overspeed protection.

It is a related object of our invention to provide an improved overspeed protective system that may be reset after an overspeed tripping operation whether or not normal fluid pressure is restored.

It is still another object of our invention to provide an engine overspeed protective system including a normally latched expandable link, an automatically resetting hydraulic actuator for unlatching the link, and means for manually resetting the expandable link and for then moving the fuel control linkage to the starting position without disabling overspeed protection.

In carrying out our invention in one form, we provide, in an engine fuel control linkage primarily operable by a throttle controlled constant speed main governor, an expandable spring link normally latched in a contracted or cocked condition and interposed between the fuel control member, or fuel rack, and the main governor. The spring link is provided with hydraulic latch actuating means responsive to engine overspeed to unlatch the link, whereupon the link expands to move the fuel rack to a fuel cutoff position independently of the main governor position. The hydraulic actuator resets automatically after an unlatching operation whether or not hydraulic pressure returns to normal, so that the overspeed spring link may be reset manually to its latched, contracted condition prior to restarting the engine. By utilizing an overspeed link manually resetable independently of engine restart (and normal hydraulic pressure) we are able to locate a manual lever for manipulating the fuel racks to starting position at a point in the fuel linkage between the expandable overspeed link and the main governor. We further provide a manually extensible reset coupling between the governor and the fuel lever so that the lever, when moved in a direction to extend the coupling, resets the expandable overspeed link to its normal latched position. When moved in the opposite direction, the fuel lever actuates the fuel racks to starting position while retaining overspeed protection.

Our invention will be more fully understood and its several objects and advantages further appreciated by referring now to the following detailed specification taken in conjunction with the accompanying drawings.

DETAILED DESCRIPTION

Figure 1:
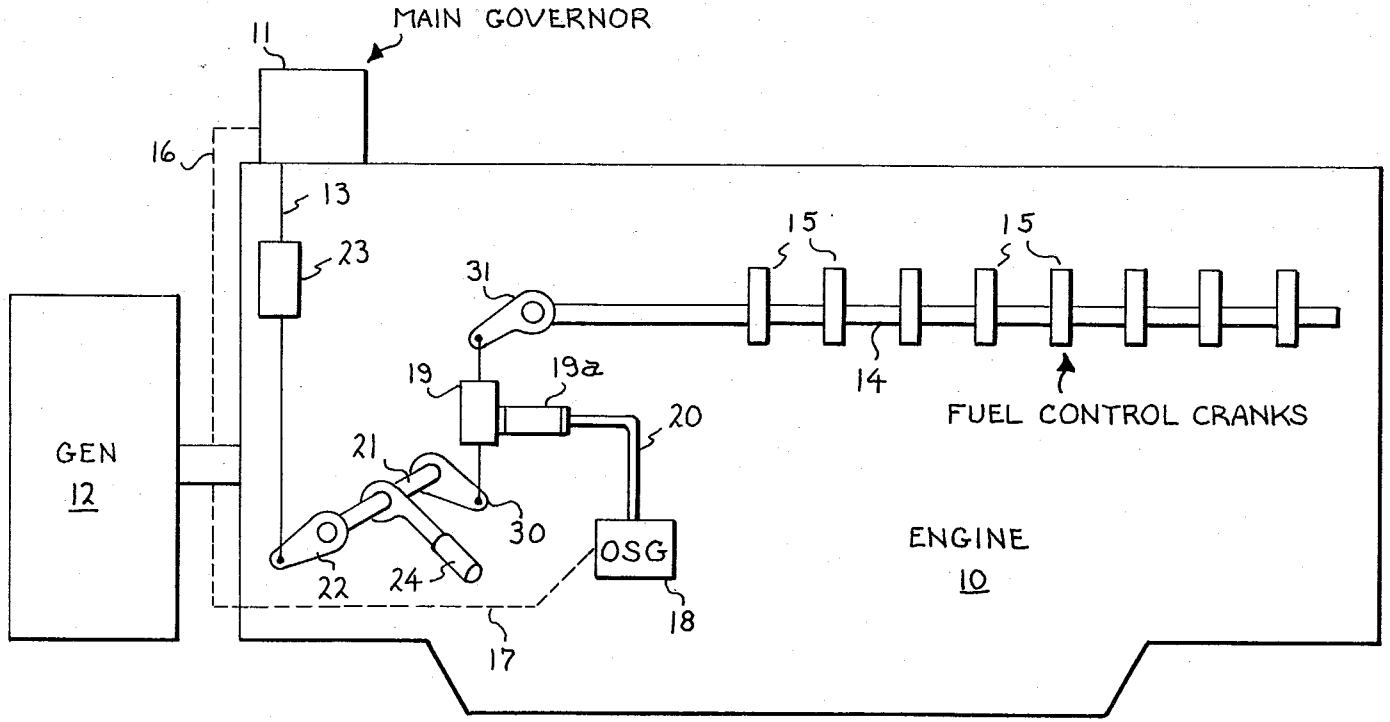
FIG. 1 is a schematic elevational view of an internal combustion engine-generator apparatus showing (partially in perspective) the general relationship of parts in a fuel control and overspeed protective system embodying our invention.
Figure 2:
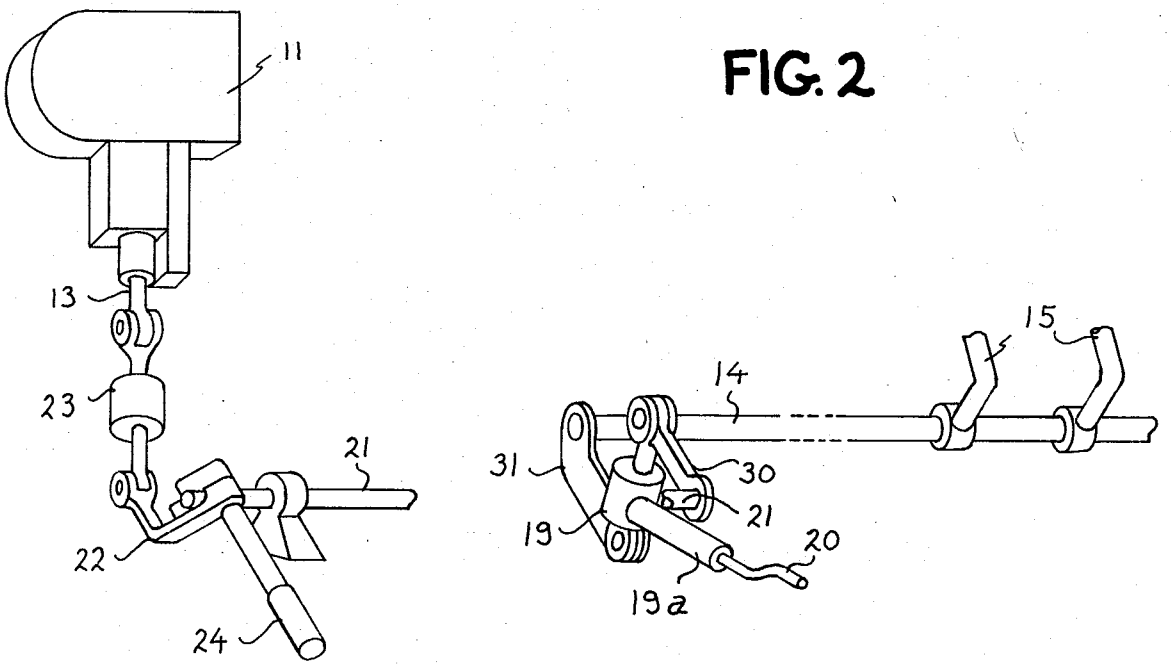
FIG. 2 is a schematic perspective view of an engine fuel control linkage embodying our invention.

Referring now to the drawing, and particularly to FIGS. 1 and 2, we have shown a fuel control and overspeed protective system embodying our invention in association with an internal combustion engine 10 having a main manually controllable constant speed governor 11 and connected to drive at selectable constant speeds an electrodynamic machine 12. The main governor output or power piston rod 13 actuates a mechanical fuel linkage which includes at its output end an angularly movable fuel control shaft 14. The fuel control shaft 14, sometimes referred to as a layshaft, carries a plurality of fuel control cranks 15 respectively associated with a corresponding plurality of engine cylinders. The fuel cranks 15 are linked to the fuel racks of fuel injection pumps (not shown), as is well understood by those skilled in the art. As indicated by the broken lines 16 and 17 in FIG. 1, the main governor 11 and an overspeed governor 18, respectively, are driven at speeds proportional to the rotational speed of the engine crankshaft.

The fuel linkage illustrated at FIGS. 1 and 2 includes also an expandable overspeed protective link 19 which is normally retained in a contracted or cocked condition and is tripped to its extended condition by a hydraulic actuator 19*a* in response to a fluid pressure signal generated by the overspeed governor 18 and transmitted through a fluid conduit 20. The fuel linkage further includes a governor layshaft 21 angularly moveable by the main governor 11 through a lever arm 22. The governor output rod 13 is connected to lever arm 22 by a manually extensible spring coupling 23 which is normally in a contracted condition. Attached to governor layshaft 21 is a manually operable fuel lever 24 movable in one direction to extend the coupling 23 and to reset the overspeed link 19 and in the other direction to move the fuel cranks 15 to a fuel supplying position for starting the engine.

Referring now more particularly to FIG. 2, the relationship of the expandable overspeed link 19, the manual fuel lever 24, and the extensible resilient coupling 23 will be more evident. As is schematically illustrated at FIG. 2, the main governor 11 includes the output piston rod 13 connected to one end of the normally contracted coupling 23 and reversely movable by governor action to increase or reduce the quantity of fuel supplied to the engine cylinders, as controlled by the angular position of the fuel control cranks 15. Through the manually extensible coupling 23 and the lever arm 22 the governor layshaft 21 is angularly positioned directly in proportion to linear displacement of the main governor output rod 13 in normal governor operation. As previously indicated, a manual lever 24 affixed to the governor layshaft 21 may be used to position this shaft independently of main governor action.

At its end opposite lever 22 the governor shaft 21 carries a lever arm 30 disposed in juxtaposition with a lever arm 31 mounted upon the fuel control shaft 14. The expandable overspeed link 19 is connected in driving relation between the free ends of lever arms 30 and 31, thereby to connect the governor shaft to actuate the fuel control shaft 14. As is indicated schematically in FIG. 2, the link 19, normally latched in a contracted position, is associated with a hydraulic latch actuator 19*a*, and actuator 19*a* is coupled by conduit 20 to a fluid pressure pump (not shown) forming a part of the overspeed governor 18 (FIG. 1).

Figure 3:
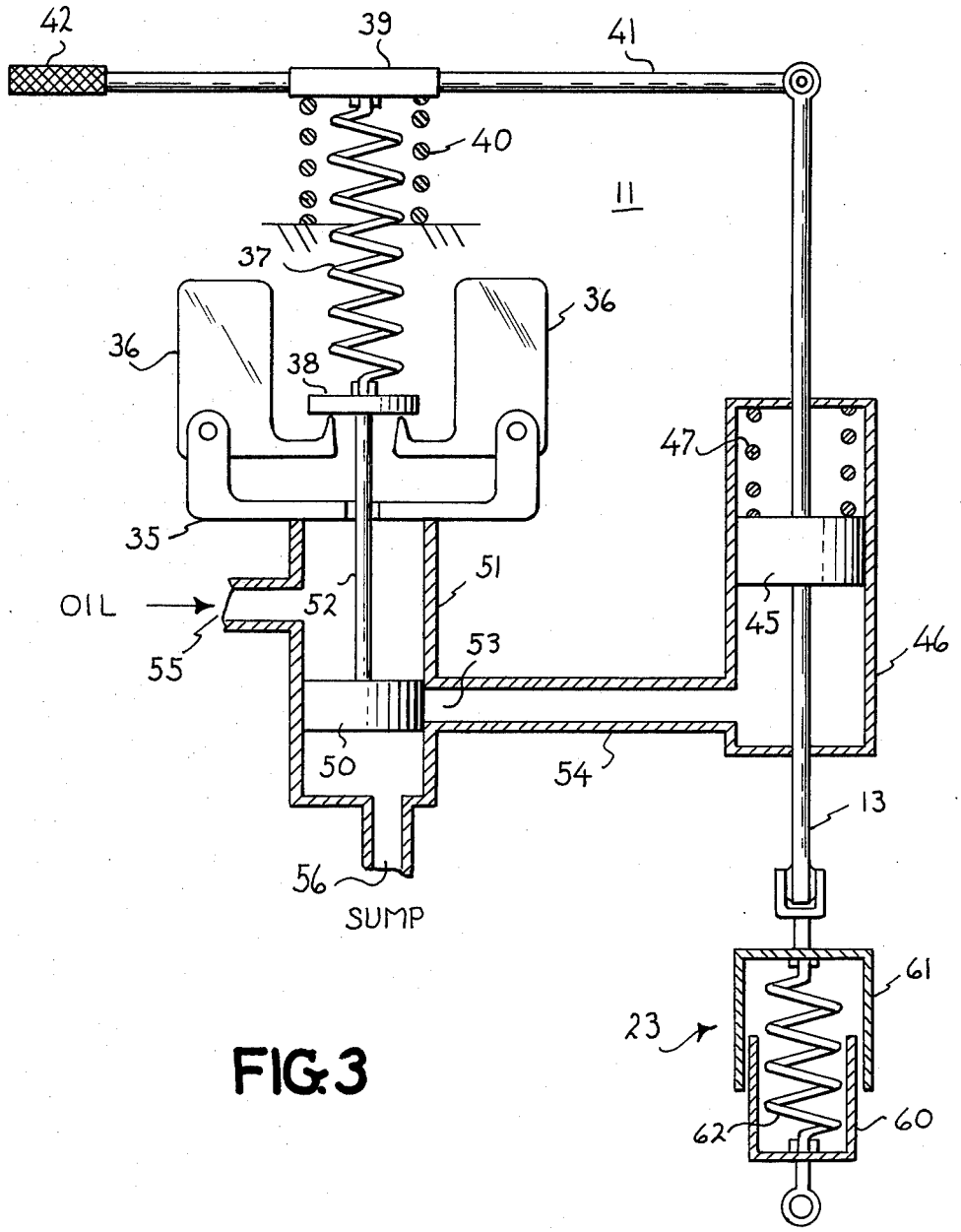
FIG. 3 is a simplified cross sectional view of a main governor of a type we prefer to use in our fuel control system, including the associated manually extensible link.

At FIG. 3, there is shown in simplified diagrammatic form a main governor of a type which is well adapted for use in the fuel control and protective system embodying our invention. As illustated at FIG. 3, the main governor 11 comprises a frame 35 rotatably driven at a speed proportionate to engine speed and having pivotally mounted thereon a pair of fly weights 36. The fly weights 36 are biased radially inward to an initial or zero speed position by a compression spring 37 bearing at one end upon a floating abutment 38 engaged by the flyweights and movable to compress spring 37 as the flyweights move radially outward when engine speed increases. The upper end of the compression spring 37 is seated upon an adjustable abutment 39 carried by a helical spring 40 mounted upon the governor frame. The adjustable abutment 39 is mounted intermediate the ends of a lever 41 pivotally mounted at one end upon the main governor power piston rod 13 and having at its opposite end a plate 42 whose vertical position is determined by the position of a manual throttle handle (not shown). The power piston rod 13 carries intermediate its ends a piston 45 slidable within a hydraulic cylinder 46 and biased in one direction (downwardly as shown in the drawing) by a compression spring 47.

To control the power piston 45 and position it in cylinder 46 as required to maintain the flyweights 36 at their normal constant speed operating position, a pilot valve 50 in a valve cylinder 51 is connected by valve rod 52 to the weight controlled spring abutment 38. The valve cylinder 51 is provided with a fluid outlet port 53 connected by a fluid conduit 54 to the governor power cylinder 46. Hydraulic fluid, such as oil under pressure from an engine driven pump (not shown), is supplied to the valve cylinder 51 through an inlet port 55 at one side of valve 50. At the other side of valve 50 the valve cylinder 51 is bled to a sump as at 56.

In normal constant speed governing operation the pilot valve 50 of main governor 11 moves upward or downward in the valve cylinder 51 as the flyweights 36 move radially inward or outward from their normal "on speed" position. The valve cylinder outlet port 53 is positioned at a longitudinally intermediate point in the cylinder and is closed by valve 50 when the flyweights 36 are positioned as shown at the desired constant speed. It will now be evident that, in principle, the throttle controlled main governor 11 illustrated at FIG. 3 operates as follows:

In the shut-down condition of the engine, the pilot piston 50 is in the lower part of the valve cylinder 51, so that the conduit 54 is connected to oil inlet port 55. The power piston 45 however, is biased by the spring 47 to its lowest (fuel cutoff) position because no pressurized oil is supplied to valve port 55 with the engine at rest. When the engine is started the plate 42 on the lever 41 is set to position the adjustable spring adjustment 39 at a predetermined desired speed setting, the pivoted end of the lever at this time being fixed in position by the downwardly biased power piston 45. As the engine is cranked, oil under pressure is supplied to the valve inlet port 55 and transferred by conduit 54 to the power cylinder 46, thus moving the piston 45 upward against the spring 47 thereby to move the fuel cranks 15 to fuel supplying position. Oil under pressure thus passing through the valve cylinder 51 to the power cylinder 46 continues to raise the power piston 45 until engine (and flyweight) speed is sufficient to raise the valve 50 to a position where it closes the port 53. In FIG. 3 the main governor is shown in a normal running position at a desired speed with the valve port 53 closed off by the valve 50 and the power piston rod 13 thus in a position to supply just sufficient fuel to maintain engine speed under the existing load condition.

In order to start the engine it may be necessary to use the manual fuel lever 24. If, for example, cranking does not generate sufficient oil pressure at the valve port 55 to move power piston 45 upward, the piston may be raised and the fuel cranks moved to fuel supplying position by moving the lever 24 clockwise as shown at FIG. 2. Also, if the overspeed link 19 has tripped, as will be more fully explained hereinafter, the fuel cranks 15 cannot be positioned to supply fuel even though governor piston 45 is in its upper full speed position. In this case the lever 24 is first moved counterclockwise (FIG. 2) to reset the overspeed link 19 and then clockwise to manipulate the fuel linkage to fuel supplying position.

If now it is desired to increase or decrease engine speed, throttle responsive means moves the plate 42 and hence the floating abutment 39 downward to increase and upward to decrease engine speed. Assuming the plate 42 and the adjustable abutment 39 to be moved downwardly, the compression spring moves the flyweights 36 slightly inward, thereby lowering the pilot valve 50 and introducing to high pressure oil the conduit 54. Oil supplied through the conduit 54 under pressure raises the power piston 45 against its bias spring 47, thereby moving the entire fuel control linkage, including the fuel control shaft 14 and the fuel cranks 15, to a fuel increasing position. In so doing, the power piston 45 resets the pivot point of the throttle level 40, thereby to move the spring abutment 39 slightly upward and reduce the biasing force of spring 37 on flyweights 36. The flyweights and the floating abutment 38 then return to the normal balance position shown wherein the valve 50 again closes off the port 53, leaving the power piston 45 in a slightly upwardly adjusted position to increase the supply of fuel to the engine.

If now, due to added load on the generator, the engine tends to slow down, the flyweights 36 move inwardly thereto to lower the pilot valve 50 and admit oil under pressure to the conduit 54. The oil thus supplied to the power piston cylinder 46 further raises the power piston 45 and again slightly readjusts the position of the adjustable abutment 39 to a new balance point so that the flyweights again return to the normal run position shown with the power piston 45 left in a higher increased fuel position.

The reverse operations upon manual decrease of engine speed and decrease of engine load will be evident to those skilled in the art from the foregoing description.

FIG. 3 also shows the resiliently extensible coupling 23 in cross section. In the illustrative form shown it comprises a pair of tubular members 60, 61 biased into telescoping relation by an axial internal tension spring 62.

Figure 4:
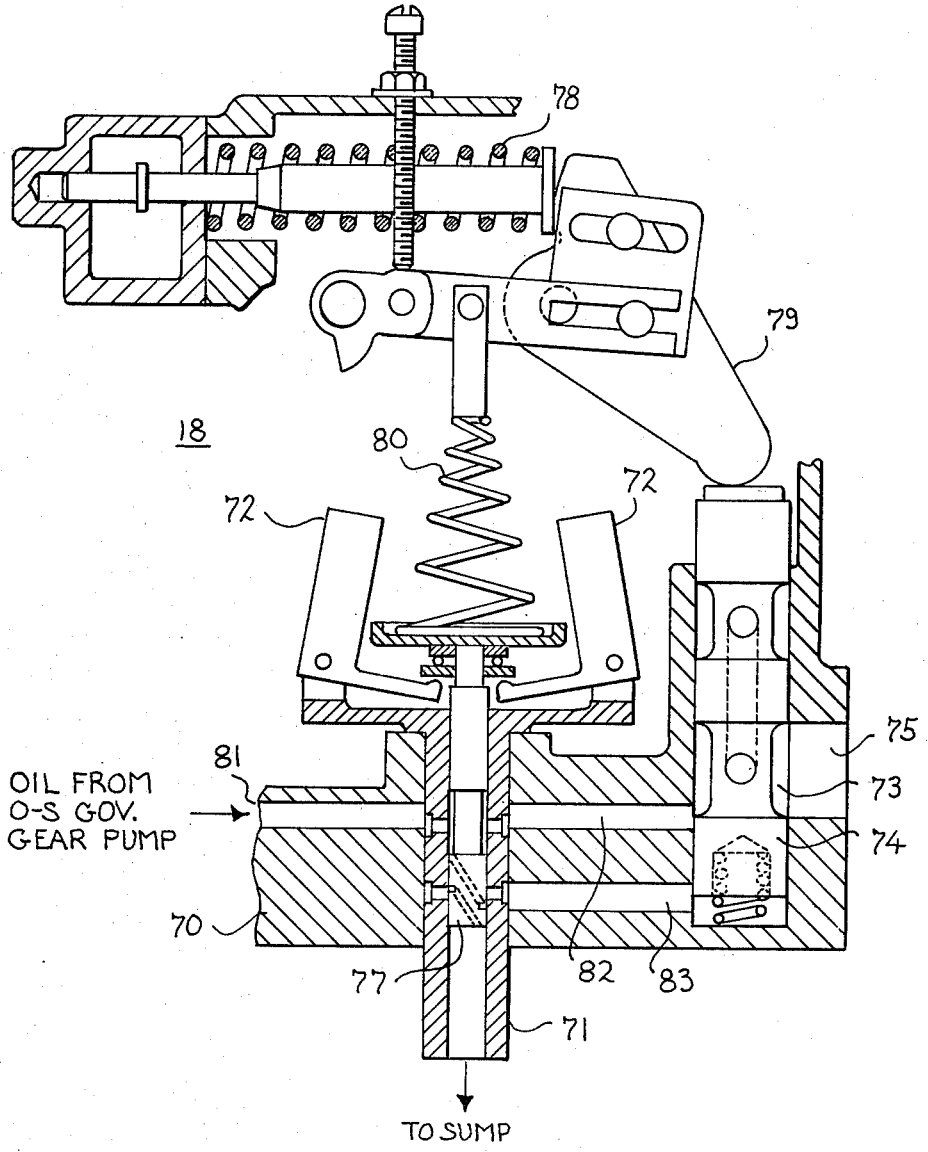
FIG. 4 is a cross sectional view of an automatically resetable overspeed governor adapted for use in the protective system of our invention.

At FIG. 4, we have illustrated a type of overspeed governor (18, FIG. 1) adapted to be utilized in the fuel supply and protective system embodying our invention. The overspeed governor illustrated at FIG. 4 comprises a housing 70 having rotatably mounted therein an engine driven spindle 71 carrying a pair of flyweights 72. A power cylinder 73 formed in the housing 70 has a power piston 74 slidably mounted therein and a fluid outlet port 75. The piston 74 is biased downward by a spring 78 bearing upon a pivoted lever 79 which engages the piston. The flyweights 72, which are biased radially inward by a spring 80 disposed in compression between their feet and the lever 79, actuate a pilot valve plunger 77. Oil under high pressure is supplied to fluid passages 81 and 82 in the housing 70 by a gear pump (not shown) coupled to the engine-driven spindle 71. In FIG. 4 the overspeed governor is shown in its normal speed running condition wherein piston 74 is held down by spring 78 and lever 79 so that passage 82 communicates with the outlet port 75 and pressurized oil is supplied to the conduit 20 (FIG. 2).

In operation of the overspeed governor or FIG. 4, when the flyweights 72 attain a radially outward position characteristic of a predetermined excessive engine speed (e.g., 1,160 RPM), the pilot valve plunger 77 moves upward to admit pressurized oil from the fluid passage 81 to a fluid passage 83 leading to the underside of the power piston 74. The connection of the passageway 83 to the sump is simultaneous closed. Pressurized oil in the passage 83 raises the piston 74 against the spring 78 to a position closing the passage 82 and uncovering the top of cylinder 73, whereby pressurized oil in cylinder 73 is released inside the housing 70 which has a drain hole (not shown) connected to the engine sump. Thus, at the predetermined excessive engine speed, the overspeed governor acts to effect an abrupt reduction of oil pressure at the outleg port 75 and in conduit 20 (FIG. 2) connected to the hydraulic overspeed link actuator **19*a***.

It will be noted that following a tripping operation of the overspeed governor 18, the engine 10 is shut down and the flyweights 72 collapse when brought to standstill. As soon as the engine speed drops below the predetermined trip point, the pilot valve pistion 77 is moved downward sufficiently to connect passage 83 to the sump. Spring 78 and lever 79 then automatically reset the power piston 74 to the operative pistion shown at FIG. 4.

Figure 5:
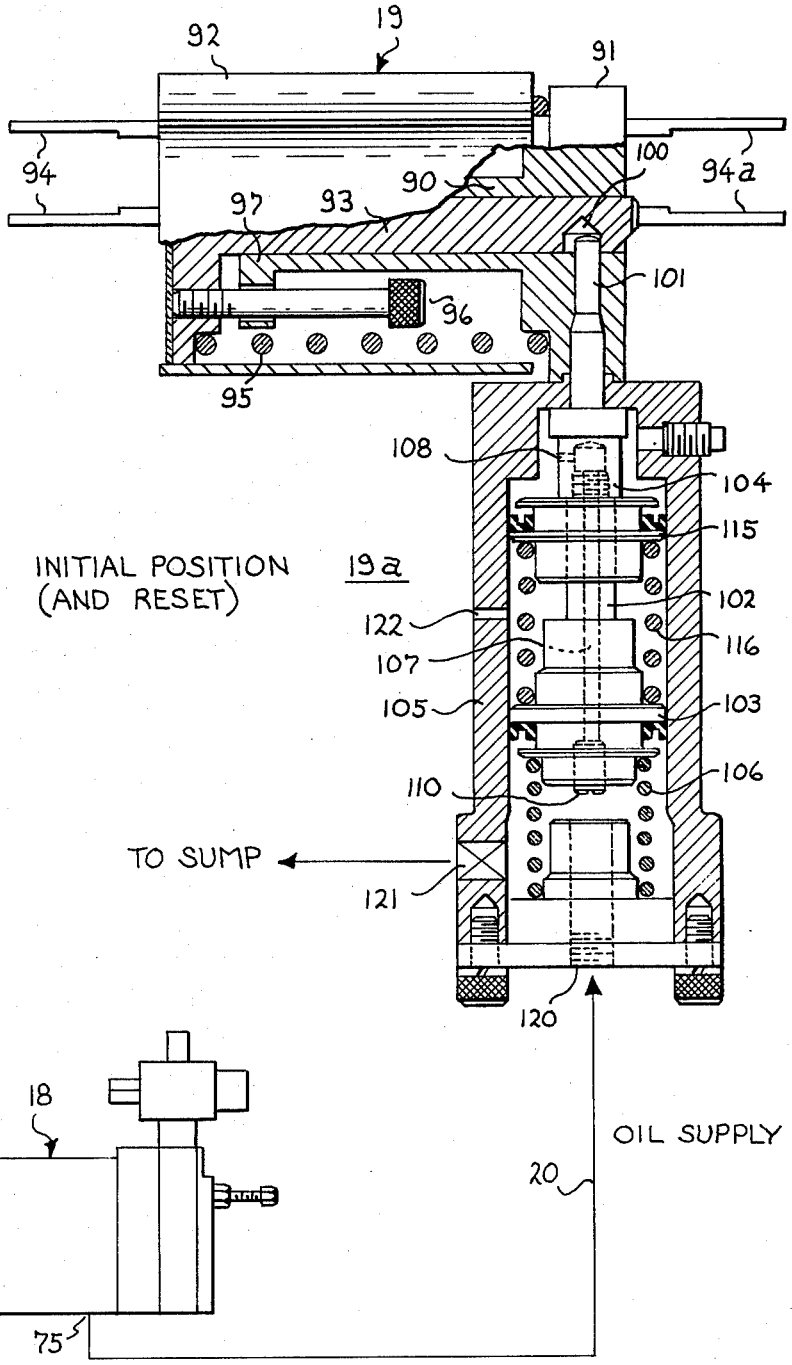
FIG. 5 is a cross sectional view of an expandable overspeed link and resetable hydraulic actuator utilized in the protective system of our invention, showing the hydraulic actuator in its initial (and reset) condition and including schematically its relation to the overspeed governor.

Referring now to FIG. 5, we have shown the expandable overspeed link 19 in itts latched or cocked position and the latch actuator **19*a* in an initial unpressurized (and reset) condition. HYdraulic connection of the actuator to the overspeed governor 18 is illustrated schematically. Preferably the link 19 and the actuator 19*a* are constructed and arranged in accordance with the teachings of the above-referenced concurrently filed patent application of P. M. Folger. The expandable overspeed link 19 comprises a tubular sleeve 90 fixed in an annular end plate 91 and a tubular cup 92 having fixed in its base an axial rod 93 which is slidably mounted in the sleeve 90. The cup 92 and the end plate 91 are provided externally with clevises 94, 94*a* for coupling the link 19 in the fuel linkage between the lever arms 30 and 31 (FIG. 2). A compression spring 95 between the end plate 91 and the base of the cup-like housing 92 biases the end plate and housing to axially spaced apart positions, thereby tending to increase spacing between the two clevises 94, 94*a*. Such axial extension is limited by one or more stop bolts 96 mounted in the base of the housing cup 92 and passing through peripheral apertures in an annular flange 97 at the free end of sleeve 90. The slidable rod 93 is notched at its free end, as at 100, to engage a releasable pin 101 of the hydraulic actuator 19***a*, thereby normally to restrain the expandable link 19 in a contracted or cocked condition with its spring 95 compressed as shown at FIG. 5.

In the hydraulic actuator 19*a*, the output pin 101 constitutes an upper end extension of a latch member comprising a piston rod 102 having at its lower end a main actuating piston 103 and an intermediate annual shoulder 104. The piston 103 is slidably mounted within a hydraulic cylinder 105 and biased upwardly by a reset spring 106 to bring the pin 101 into latching relation with the spring actuated axial rod 93 in the expandable link 19. The piston 103 and piston rod 102 are provided with an axial fluid passage 107 terminating at its upper end in a radial outlet port 108 in the annual shoulder 104. At its lower end the fluid passage 107 terminates in a constricted metering orifice 110 opening into a lower chamber in the cylinder 105 beneath the main piston 103.

Slidably mounted upon the piston rod 102 within the hydraulic cylinder 105, and axially movable between actuating piston 103 and the abutment 108, is an auxiliary, or floating, piston 115. The piston 115 serves as a floating abutment for a helical compression spring 116, which bears at its other end upon the upper side of the main piston 103. The spring 116 biases the piston 115 against the annular abutment 104 and into axially spaced relation on rod 102 with respect to piston 103. The spring 116 is sufficiently strong to overcome the upward force of the reset spring 106. As will become evident, the spring 116 acts as an actuating spring to move the piston 103 and pin 101 downward in tripping operation.

The hydraulic cylinder 105 of the latch actuator 19*a* is suitably mounted on a sidewall of the end plate 91 of the expandable link 19. At its lower end the cylinder 105 is provided with an axial fluid inlet port 120 and a pressure relief valve 121. The axial fluid passage 107 in the piston rod 102 connects the lower hydraulic chamber of cylinder 105 beneath piston 103 with an upper chamber above piston 115. A vent 122 is provided in the wall of cylinder 105 intermediate the pistons 103, 115 so that free movement of these pistons is not impeded by air pressure building up in the space between them. The fluid inlet port 120 is connected through conduit 20 to the fluid outlet port 75 of the overspeed governor 18 (FIG. 4). The relief valve 121 of actuator cylinder 105 is connected to the engine sump as schematically illustrated in FIG. 5. In FIG. 5 the hydraulic latch actuator 19*a* is shown in its initial unpressurized condition, which is also its reset condition following a tripping operation and the resetting of the expandable link 19.

Figure 6:
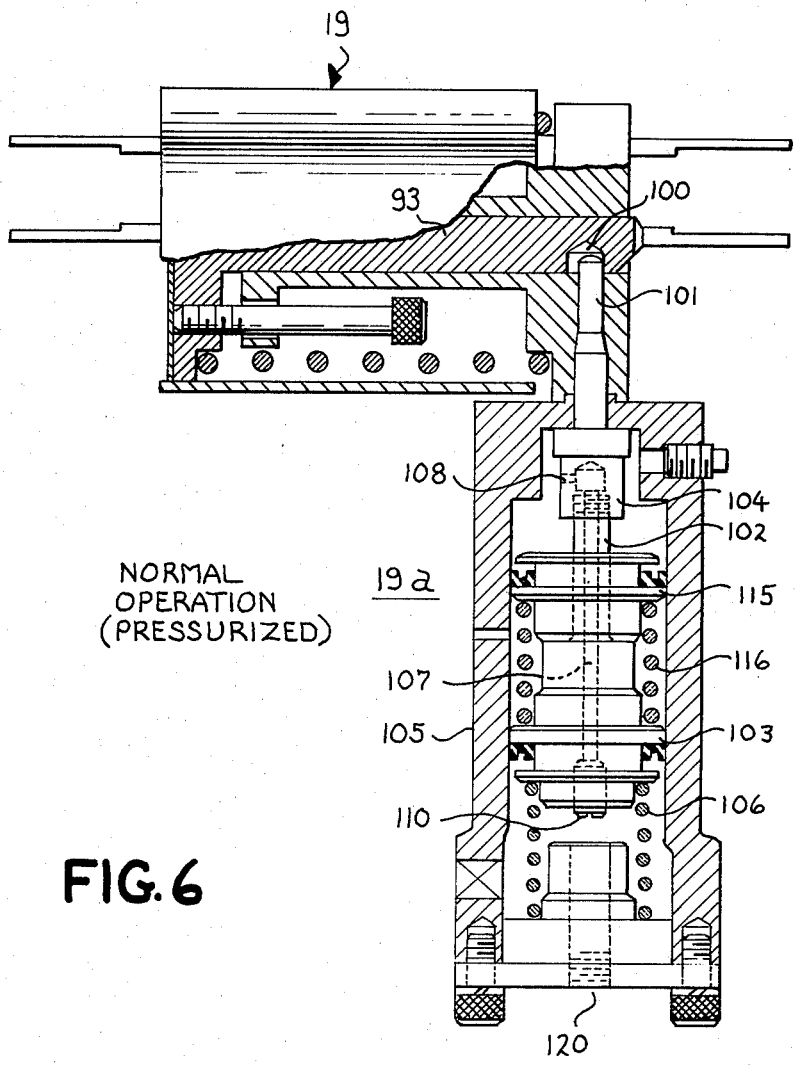
FIGS. 6 and 7 are cross sectional views of the overspeed link and actuator of FIG. 5 in normal operating and tripped positions, respectively.

If now the engine is brought up to speed so that oil under pressure is supplied from the overspeed governor to the actuator inlet port 120, fluid fills the lower chamber of the cylinder 105 and is transferred through the metering aperture 110, the axial passage 107, and the radial passage 108 to the upper chamber above the floating piston 115. Because of the constricted metering orifice 110, equalization of pressure below the piston 103 and above the piston 115 is slightly delayed, but during this equalization the greater fluid pressure below the piston 103 and the reset spring 106 retain the latching pin 101 in the latching notch 100. As the fluid pressure above the floating piston 115 becomes equal to that below the actuating piston 103, the piston 115 is pushed downward along the rod 102 and into engagement with a collar of piston 103, as shown at FIG. 6. In this pressurized condition of the hydraulic actuator 19*a*, the piston 103 and latch pin 101 are retained in their upper latching positions, while the floating piston 115 is pressed downward along the rod 102 and into engagement with the piston 103, thereby to compress and charge the actuating spring 116. This is the final pressurized or cocked operating position of the actuator 19*a*, with fluid pressure (e.g., approximately 300 PSI) equalized below the piston 103 and above the piston 115.

If now fluid pressure at the inlet port 120 of the actuator 19*a* is abruptly reduced, as by operation of the overspeed governor in connecting its output port 75 to the sump, fluid pressure below the piston 103 (FIG. 6) is suddenly brought to zero or significantly reduced, while reduction of pressure above the piston 115 is delayed by the action of the metering orifice 110. The actuating spring 116 between the pistons 103 and 115, therefore, acts immediately to move the piston 103 downward while the piston 115 is still held against movement by fluid pressure in the upper chamber of cylinder 105. Downward movement of piston 103 moves the latch pin 101 to its unlatching position and releases the spring actuated expandable overspeed link 19 for axial extension to the condition shown in FIG. 7. In a practical embodiment of the invention, a force of 60 pounds is required to pull pin 101 out of the notch 100 in the spring-loaded slidable rod 93 of link 19, and the trip spring 116 was made twice that strong. The reaction time of the described system is so fast that the link 19 attains its extended condition in only a small fraction of a second after the overspeed governor senses an engine overspeed.

Following such instantaneous latch releasing action, fluid pressure above the floating piston 115 is gradually reduced through the metering orifice 110, so that the reset spring 106 can lift the latch member 102, 103, 104 and the floating piston 115 as a unit to a reset position which is the same as the initial position (FIG. 5) of these parts. With substantially equal oil pressures in the chamber above piston 115 and in the chamber below piston 103, this automatic resetting action of the spring 106 is augmented by a net upwardly directed hydraulic force due to the exposed area of the lower face of piston 103 being larger than that of the upper, annular face of piston 115. Once the actuator 19*a* is reset, the latch pin 101 is in a raised position in which it will recapture the slidable rod 93 of the overspeed link 19 whenever the latter component is returned to its normal contracted or "closed" condition by reset operation of the manual fuel lever 24 of the overspeed protective system. Upon resetting the link 19, its rod 93 is moved from the FIG. 7 position to the FIG. 5 position; in the process the latch pin 101 (and associated parts) of the actuator 19*a* rides down the inclined free end of the rod 93 and then snaps back into its latched position (FIG. 5) under the influence of the reset spring 106.

Figure 7:
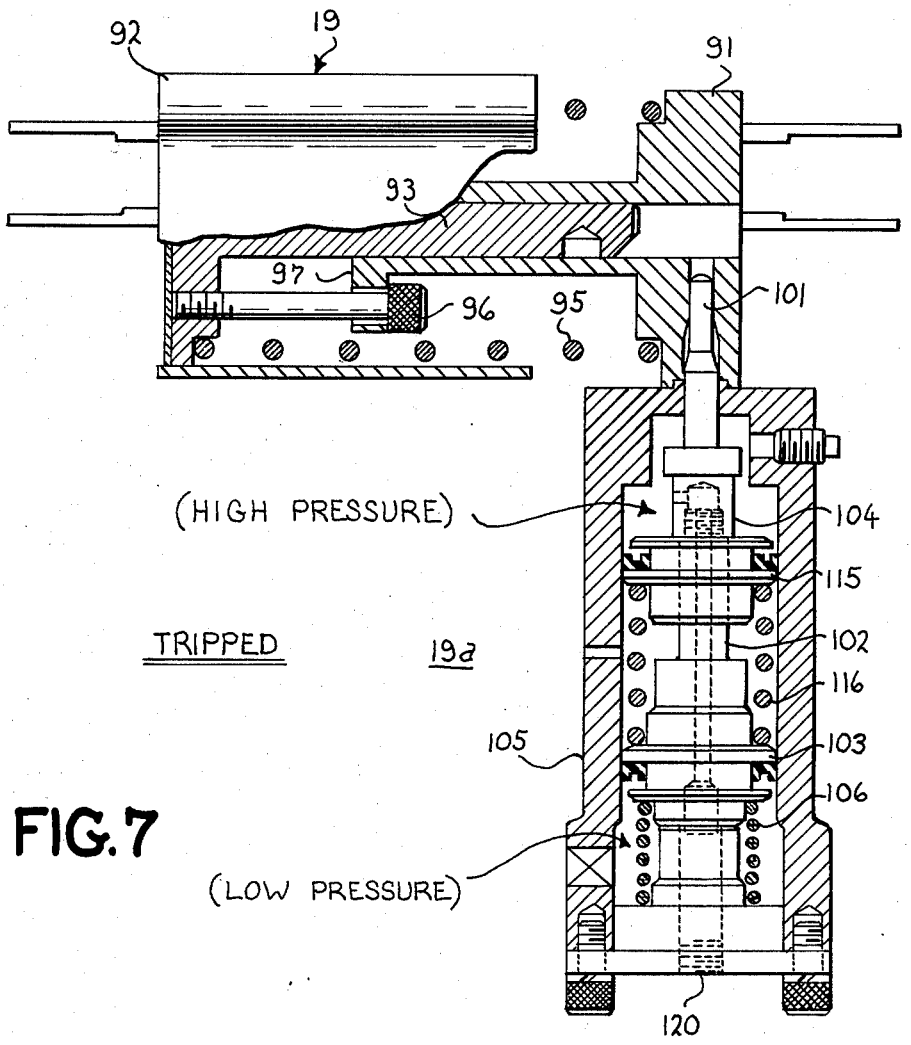

It may now be observed that the hydraulic actuator illustrated at FIGS. 5, 6, and 7 is automatically resettable whether or not normal positive fluid pressure at inlet 120 is restored. If such pressure is not restored, pressure below the piston 103 and above the piston 115 will equalize at substantially zero and the parts will return to the reset position shown at FIG. 5. Subsequently, whenever fluid pressure is restored at the inlet port 120, fluid traverses the passage 107 with some slight delay and again equalizes the pressure above piston 115 with that below piston 103 so that the reset spring 106 is equally effective. The floating piston 115 then returns to the lower position of FIG. 6, thereby cocking or charging the trip spring 116.

It will now also be apparent to those skilled in the art that the latch actuator 19*a* has the unique and desirable feature of being unresponsive to normal shutdown of the engine 10. Upon stopping the engine by normal operation of the throttle-controlled main governor 11, the engine speed decreases gradually and the corresponding decrease in hydraulic pressure at the inlet port 120 of the actuator 19*a* will also be gradual, not abrupt. For example, the transition from full pressure to zero pressure may take approximately 30 seconds. The small orifice 110 in the fluid passage 107 between the lower and upper chambers of the actuator cylinder 105 is sufficiently large to permit such a slow loss of pressure in the upper chamber, and consequently the pressure will drop substantially uniformly in both chambers. With decreasing but equalized oil pressure below the piston 103 and above the piston 115, the latch member 101–103 of the actuator 19*a* is maintained in a latched position (FIGS. 5 and 6) while the piston 115 is able to float upwardly from its position in FIG. 6 toward its position in FIG. 5. Consequently the actuating spring 116 is uncocked or discharged without unlatching or tripping the overspeed link 19 during normal shutdown of the engine 10.

In view of the foregoing detailed description of the elements of our improved fuel control and protective system, its mode of operation will now be evident to those skilled in the art from the following brief description:

Assuming that the throttle is set for constant speed operation at some selected speed in the normal range of speeds and that the main governor pilot valve 50 is in its "on speed" position shown in FIG. 3, the governor power piston 45 will be positioned in cylinder 46 at a fuel feeding location proportionate to load on the engine. If now for any reason the engine 10 speeds up to a point sufficient to actuate the overspeed governor (FIG. 4) and open its outlet port 75 to the sump, oil pressure is abruptly relieved at the inlet port 120 of the hydraulic latch actuator 19*a*. The actuator 19*a* functions in the manner previously described to move the latch member 101, 102, 103 downward, thereby releasing the notched extension rod 93 in the link 19 (FIG. 5). The actuating spring 95 quickly expands the link 19 from its predetermined normal length to a different, greater length which forces the fuel control shaft 14 (FIG. 2) to rotate to a fuel shutoff position independently of movement of the governor layshaft 21. When the engine shuts down, oil pressure in the lower chamber of the actuator cylinder 105 remains at substantially zero, but, as described above, the pistons 103 and 115 within the actuator cylinder 105 automatically reset the latch pin 101 to its upper position in readiness for resetting of the normally latched slidable rod 93 in the expandable link 19.

Referring now to FIG. 2, it will be observed that by raising the fuel lever 24, i.e., moving it in a counterclockwise direction, the layshaft lever 30 is moved in a counter-clockwise direction thereby to compress the overspeed link 19 against the fuel control shaft lever 31 which is now stopped by cranks 15 in its fuel cut-off position. This resetting motion tends to return the link 19 to its normal length. In the process the main governor power piston 45 is pulled downward and bottoms at its lowest point in the cylinder 46 (FIG. 3) before the notch 100 in the rod 93 of the link 19 is repositioned to accept the latch pin 101 of the actuator 19*a*. For this reason the coupling 23 between the power piston 45 and the governor layshaft 21 is arranged to be resiliently extended by manual resetting movement of the fuel lever 24, thereby permitting the expandable link 19 to be fully reset and latched in its normal condition (FIG. 5). With the link 19 reset, the fuel lever 24 may now be moved in a downward, or clockwise, direction (FIG. 2), thereby overriding the governor 11 to rotate the layshaft 21 clockwise and, through the levers 30 and 31 and the overspeed link 19, to rotate the fuel control shaft 14 in a counterclockwise direction to increase fuel supply to the engine cylinders.

It is now fully evident that in the foregoing manual restarting operation the overspeed protection provided by the link 19 is fully effective because the link is interposed between the fuel lever 24 and the fuel racks 15. It is possible to so locate the overspeed link 19 because the hydraulic actuator 19*a* and the overspeed governor 18 reset automatically, and manual resetting of the normally latched overspeed link 19 is permitted by provision of the resilient coupling 23 between the main governor and the fuel lever 24.

While we have described and illustrated a preferred embodiment of our invention by way of illustration, many modifications will occur to those skilled in the art, and we therefore intend in the appended claims to cover all such modifications as fall within the true spirit and scope of the invention.

We claim:

1. In an overspeed protective system for an internal combustion engine having a movable fuel control shaft, a speed responsive governor, a movable governor layshaft coupled to said governor for actuation thereby, throttle means for selecting the setting of said governor thereby to maintain a desired constant speed within a normal range of speeds, manually operable means connected to actuate said layshaft independently of said throttle means, a connecting link of variable length coupling said layshaft to actuate said fuel control shaft, said link having a predetermined normal length and being abruptly changeable to a different length which forces said fuel control shaft to move in a fuel reducing direction independently of the position of said layshaft, and means responsive to engine overspeed above the maximum of said normal speed range for causing said link to change its length, whereby engine speed is reduced upon actuation of said link independently of said governor and of said manually operable means.

2. A protective system according to claim 1 wherein said connecting link is spring biased to an extended condition and normally latched in a contracted condition.

3. A protective system according to claim 1 wherein said governor layshaft is coupled to said governor by longitudinally extensible spring means normally operable in a contracted condition and extensible by movement of said manually operable means in one direction, said manually operable means when so moved resetting to normal length said connecting link between said layshaft and said fuel control shaft.

4. A protective system according to claim 3 wherein said connecting link is spring actuated from said normal length to said different length and wherein said overspeed responsive means includes releasable latching means normally restraining said connecting link in its normal-length condition and means for releasing said latching means in response to engine overspeed, said manually operable means being effective to return said connecting link to said normal length when moved to extend said spring coupling means.

5. A protective system according to claim 4 wherein said latch releasing means is automatically resettable independently of engine speed.

6. A protective system according to claim 4 wherein said latch releasing means comprises a movable latch member, a hydraulic cylinder having a main piston therein connected to said latch member, means biasing said main piston to a latch engaging position in said cylinder, an actuating spring connected to move said piston to a latch releasing position, and fluid pressure means for charging said spring, said overspeed responsive means including means for effecting an abrupt decrease in fluid pressure supplied to said cylinder, whereby said spring actuates said piston to said latch releasing position.

7. In an overspeed protective system for an internal combustion engine, speed control means having a movable output member, a first movable fuel control member normally actuated by said output member, a resilient coupling between said output member and said first member, a manually operable lever attached to said first fuel control member to permit overriding movement thereof, a second movable fuel control member connected to control fuel input to said engine, an expandable connecting link normally latched in contracted condition interposed in driving relation between said first and second fuel control members, said link expanding when unlatched to move said second fuel control member toward fuel cut-off position independently of movement of said first fuel control member, whereby the engine is shut down upon unlatching of said link, and means including an engine overspeed governor and an actuator coupled to said governor for unlatching said connecting link in response to engine overspeed above a predetermined normal range of speeds, both said governor and said actuator being automatically resettable after engine shut down and said resilient coupling enabling reset of said connecting link by said manually operable lever.

8. A protective system according to claim 7 wherein said manually operable lever is movable in one direction to reset said connecting link to its contracted condition after engine shutdown and is movable in the opposite direction for actuating said second member to a fuel supplying position independently of said speed control means.

* * * * *